US006802255B2

(12) United States Patent
Keller et al.

(10) Patent No.: US 6,802,255 B2
(45) Date of Patent: Oct. 12, 2004

(54) INK FOUNTAIN MECHANISM

(75) Inventors: James J. Keller, Scottsdale, AZ (US); David N. Clay, Flower Mound, TX (US)

(73) Assignee: Color Control Corp., Scottsdale, AZ (US)

( * ) Notice: Subject to any disclaimer, the term of this patent is extended or adjusted under 35 U.S.C. 154(b) by 0 days.

(21) Appl. No.: 10/314,738

(22) Filed: Dec. 9, 2002

(65) Prior Publication Data

US 2004/0107853 A1 Jun. 10, 2004

(51) Int. Cl.[7] ..... B41F 31/05
(52) U.S. Cl. ..... 101/365
(58) Field of Search ..... 101/350.1, 363, 101/364, 365

(56) References Cited

U.S. PATENT DOCUMENTS

| | | | | | |
|---|---|---|---|---|---|
| 2,902,927 | A | * | 9/1959 | Ross | 101/365 |
| 3,057,294 | A | * | 10/1962 | Jameson | 101/365 |
| 3,792,659 | A | * | 2/1974 | Albrecht | 101/365 |
| 4,479,434 | A | * | 10/1984 | Armelin | 101/365 |
| 4,495,864 | A | * | 1/1985 | Junghans | 101/365 |
| 5,694,851 | A | | 12/1997 | Bruni | 101/365 |
| 5,727,463 | A | | 3/1998 | Deschner et al. | 101/365 |
| 5,960,715 | A | | 10/1999 | Voge et al. | 101/365 |
| 5,974,966 | A | | 11/1999 | Bruni | 101/169 |
| 6,012,389 | A | | 1/2000 | Roskosch et al. | 101/365 |
| 6,112,661 | A | | 9/2000 | Albiez | 101/365 |
| 6,349,645 | B1 | * | 2/2002 | Roskosch | 101/364 |

* cited by examiner

*Primary Examiner*—Daniel J. Colilla
*Assistant Examiner*—Leo T. Hinze
(74) *Attorney, Agent, or Firm*—Osha & May L.L.P.

(57) ABSTRACT

An ink fountain mechanism for adjustably metering the thickness of of ink in a plurality of zones axially across a fountain roller for a printing press includes a plurality of metering blocks, horizontally aligned and axially adjacent to one another with side-by-side upper support surfaces forming a substantially continuous support surface along the length of the fountain roller. Each upper surface of the metering blocks is adjustably spaced from the ink receiving fountain roller. A plurality of adjustment bolts are each separately and threadably engaged with each of the plurality of metering blocks. The adjustment bolts are slideably supported in a main beam that extends the length of the fountain roller. A plurality of lever actuated cams are pivotably held adjacent to the heads of each of the adjustment bolts. Metering cams are engaged with the heads of the adjustment bolts and are actuatable between a minimum position, providing a minimum ink metered thickness, and a maximum position, providing a maximum metered ink thickness. The levers actuating the metering cams are each separately and progressively movable between minimum and maximum positions to provide substantially continuous metering of the thickness of ink in a range between the minimum and the maximum ink thickness.

15 Claims, 4 Drawing Sheets

INK FOUNTAIN MECHANISM

FIELD OF INVENTION

The present application relates to an ink fountain mechanism for a rotary offset printing press, and in particular to an ink liner control mechanism.

BACKGROUND OF THE INVENTION

An ink fountain, or ink duct as it is sometimes called, is commonly connected on a rotary offset printing press for supplying ink to a fountain roller, or ductor roller. The fountain roller rotates through the ink in the ink fountain reservoir. The ink is received onto the surface of the fountain roller and then is rollingly transferred, directly or through a series of intermediate rollers, to a printing roller. It is desirable to adjust the quantity of ink received by the fountain roller so that an adequate supply of ink is provided to the printing roller while minimizing excess ink. The amount of ink required will depend upon various factors such as the viscosity of the ink, the type of paper and importantly, the density of the printing or image. The adjustment of the quantity of ink is accomplished by adjusting the thickness of the film, or the layer, of ink that the fountain roller receives onto its surface. The ink is then transferred from the ink fountain to a printing roller and then onto the printed sheet.

The density of the printing also typically varies across the printed sheet. Particularly, in the case of multiple color printing, the amount of any given color of ink may vary across the sheet, depending upon the density of the particular color in the printed image. Therefore, it is further desirable to adjust and vary the quantity of ink supplied by the fountain roller to different areas according to the print density of the different colors. To better approximate the amount of ink needed in different areas of a given sheet of printing, a plurality of axially spaced zones are identified along the length of the fountain roller. The adjustment of the quantity of ink is accomplished by adjusting the thickness of the film or layer of ink that the fountain roller receives onto its surface in each of the zones. The ink is then transferred more completely from the ink fountain to a printing roller and then onto the printed sheet with minimal waste and with improved print quality.

In the past the adjustment of the quantity of ink was attempted using an ink blade at the bottom of the ink reservoir supported at an angle against the fountain roller. The edge of the ink blade was spaced from the fountain roller a small distance forming a gap through which the ink was squeezed into a layer or film as the roller rotated. A thin ink blade was supported along its dispensing edge by the rounded tips of adjustable bolts. The bolts could be threaded in and out to adjust the pressure on the blade in the area of the bolt tips for approximated zonal control. It was found that because of the point pressure of the tips of the bolts, this mechanism for metering the quantity of ink in different zones needed improvement.

SUMMARY OF THE INVENTION

The present invention provides a unique, simplified, reliable and improved ink fountain mechanism for adjustably metering the thickness of the layer of ink in a plurality of zones axially across a fountain roller. The ink fountain mechanism includes a plurality of metering blocks, horizontally aligned and axially adjacent to one another and each having an upper surface adjustably spaced from an ink receiving fountain roller. A plurality of adjustment bolts are each separately and threadably engaged with each of the plurality of metering blocks. The adjustment bolts are slideably supported in a main beam that extends the length of the fountain roller. A plurality of lever actuated cams are pivotably held adjacent to the heads of each of the adjustment bolts. The cams are engaged with the heads of the adjustment bolts and are actuatable between a minimum position, providing a minimum metered ink thickness, and a maximum position, providing maximum metered ink thickness. The lever actuating the cam is continuously movable between the minimum and maximum positions to provide substantially continuous metering of the thickness of ink in a range between the minimum and the maximum ink thicknesses.

According to one embodiment the adjustment bolts are biased toward the cam. For example, a return spring may be held in the main beam so that it pushes against a bottom of the adjustment bolt head and such that the top of the adjustment bolt head is biased to interface against the cam. In an exemplary embodiment, the bolt head interfaces against the cam through a interface cap constructed of a material selected to provide non-binding frictional sliding contact between the cam and the cap. The size, shape and materials of the interface between the cap and the cam are selected and constructed so that the cam lever can be manually moved through the range of ink thickness metering positions, yet the cam lever and cam will remain in any desired metering position by the frictional contact between the cam and the cap. External force applied to the cam lever is required to change the metering position. In an exemplary embodiment the lever is moveable by a press operator with manually applied force. Each of the cam levers may be separately positioned to meter the ink thickness at each of the separate metering blocks.

According to another aspect the invention each cam is mounted on a mounting shaft for rotation between the minimum and maximum metering positions. Orifices are formed through the cam and the mounting shaft, that may be aligned to permit an adjustment tool to be extended through the cam and through the mounting shaft. The adjustment tool engages with the head of the adjustment bolt to thread the bolt into or out of the metering block and to thereby precisely position the metering block relative to the main beam and to the fountain roller. The threaded bolt adjustment is thus useful for precisely adjusting the minimum thickness of the ink when the cam is at its minimum position. The maximum thickness of the ink will also be adjusted upon adjusting the minimum thickness because the eccentric lift of the cam between the minimum position and the maximum position remains constant. For example, if the eccentric lift of the cam is thirty thousandths of an inch, from the minimum to the maximum positions, and the minimum ink thickness is adjusted from one thousandth of an inch thick down to zero, the maximum thickness will be adjusted from thirty-one thousandths of an inch thick to thirty thousandths of an inch thick.

DETAILED DESCRIPTION OF THE ILLUSTRATIVE EMBODIMENTS

Figure 1:
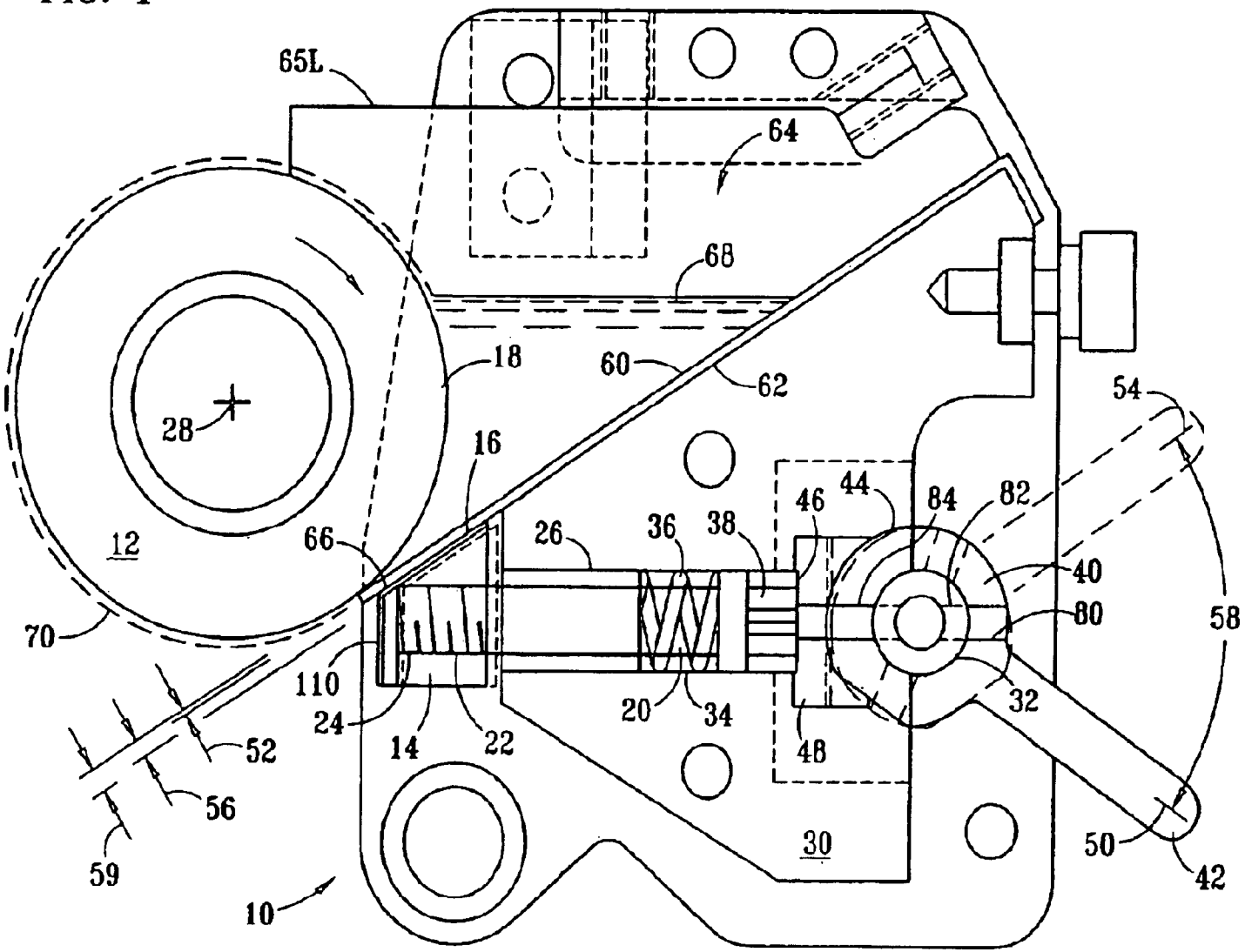
FIG. 1 is a schematic partial cross-sectional side view of an ink fountain mechanism according to one embodiment of the present invention.
Figure 2:
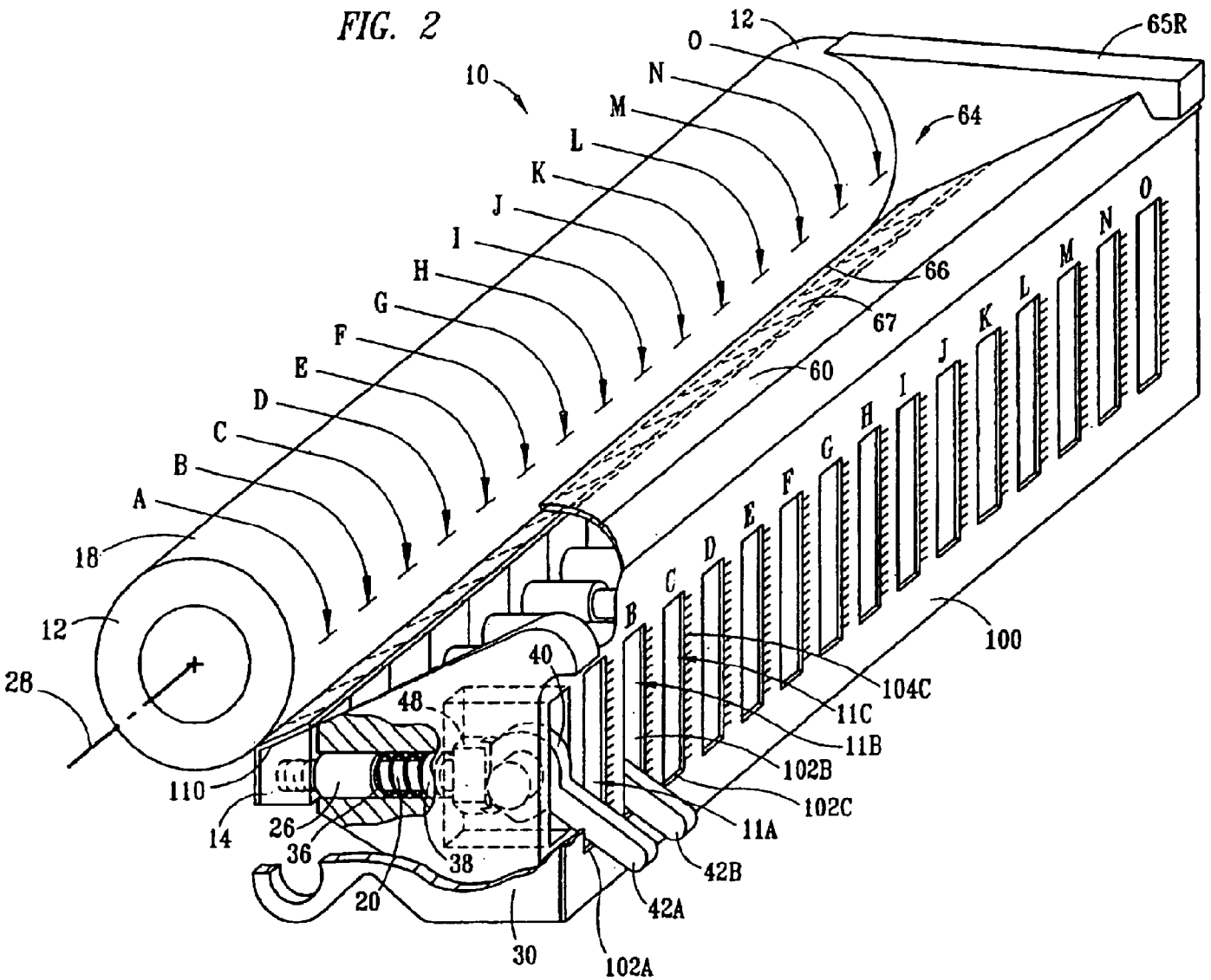
FIG. 2 is a partial cutaway perspective view of the ink fountain mechanism of FIG. 1.
Figure 3:
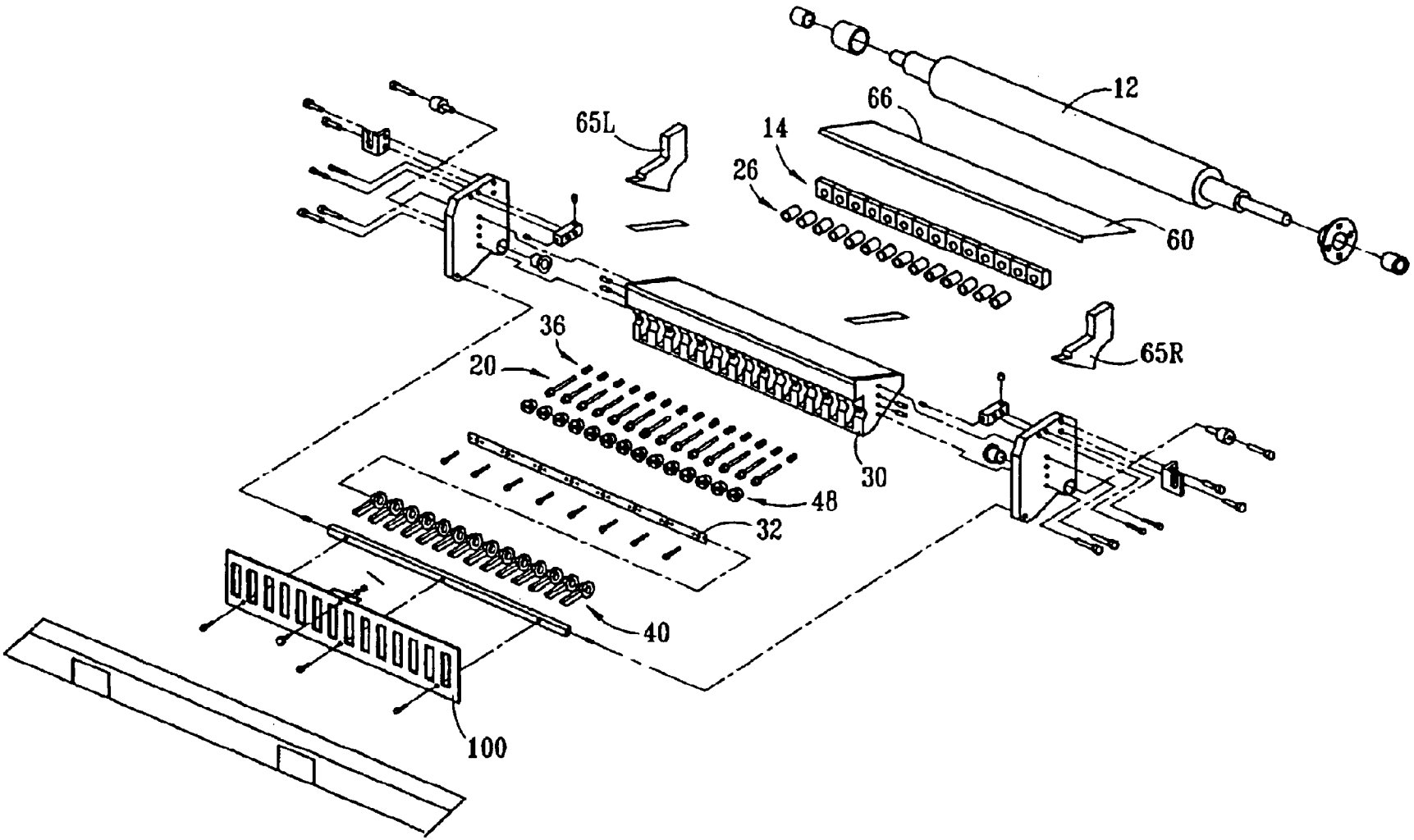
FIG. 3 is an exploded assembly view of the ink fountain mechanism of FIGS. 1 and 2.

Referring to FIGS. 1–3, it will be understood that an ink fountain mechanism, according to one embodiment of the present invention, comprises a plurality of sub-assemblies 11A–O. The number of sub-assemblies 11 may be varied without departing from the invention and may be greater or fewer depending, in part, upon the width of the printing press for which it is designed. As will be more fully understood with reference to the figures and description, the present invention provides a unique, simplified, reliable and improved ink fountain mechanism 10 for adjustably metering the thickness of a layer of ink dispensed by a fountain roller 12 in a plurality of circumferential zones A–O. Each zone A–O is generally defined as a circumferential area or band adjacent to one of a plurality of substantially identical sub-assemblies 11A–O. One sub-assembly 11 is positioned next to another along the length of the fountain roller 12. Each zone is primarily acted upon by similar components of an adjacent sub assembly. For clarity, the embodiment of FIG. 1 will be described with respect to a single sub-assembly 11 and the interrelationship between the plurality of sub-assemblies A–O will be more fully explained with reference to FIGS. 2 and 3 below.

FIG. 1, is a schematic partial cross-sectional side view of the ink fountain mechanism 10 adjacent to a fountain roller 12. The ink fountain mechanism 10 includes a metering block 14 that is horizontally aligned with and axially adjacent to other metering blocks 14 in other sub-assemblies. Each metering block 14 has an upper surface 16 adjustably spaced outward in a radial direction from an outer cylindrical surface 18 of ink receiving fountain roller 12. An adjustment bolt 20 has external threads 22 and is separately and threadably engaged with internal threads 24 formed in each metering block 14. The adjustment bolt 20 is slideably supported by a bushing 26 inserted in a bore 34 formed in a main beam 30. The main beam 30 extends parallel to the axis 28 and along the length of the fountain roller 12. A cam 40 is mounted for partial rotation on a mounting shaft 32 held by the main beam 30. The cam 40 comprises a cam surface 44 and an actuation lever 42 attached or integrally formed for manual lever actuation. The eccentric surface 44 of the cam 40 is positioned adjacent to a head 38 of the adjustment bolt 20. The cam 40 is engaged at its eccentric surface 44 with the head 38 of the adjustment bolt 18 and is manually actuatable with lever 42 between a minimum position 50, providing a minimum ink metered thickness at 52, and a maximum position 54, providing maximum metered ink thickness 56. The lever 42 that actuates the cam 40 is continuously movable in a position range 58 between the minimum and maximum positions, 50 and 54 respectively, to provide substantially continuous metering of the thickness of ink in a thickness range 59 between the minimum and the maximum ink thickness, 52 and 56 respectively. An ink liner 60 comprises a thin sheet of resilient and flexible material supported at an inclined angle by an inclined base 62 of an ink fountain reservoir 64. The ink liner 60 is supported at and along a dispensing edge 66 by the upper surface 16 of the metering block 14. The ink 68 to be dispensed and metered by the ink fountain mechanism 10 is held in the reservoir 64. The ink flows by gravity and by the rolling contact with surface 18 of fountain roller 12. The ink 68 is "squeezed" or metered between the edge 66 of the ink liner 60 and the surface 18 of ink fountain roller 12. This provides a metered thickness layer 70 of ink 68 onto the surface 18 of the fountain roller 12.

According to one embodiment, each adjustment bolt 20 is biased toward a corresponding cam 40. For example, a return spring 36 may be held circumferentially around bolt 20 within a bore 34 in the main beam 30 so that the spring 36 pushes against the head 38 of adjustment bolt 20. A top surface 46 of the head 38 of the adjustment bolt 20 is thus biased toward the cam 40. In an exemplary embodiment, the bolt head 38 comprises a cap screw head such as an Allen bolt head and the bolt head interfaces with the cam through an interface cap 48 attachable to the head 38 of bolt 20 and constructed of a material selected to provide non-binding frictional sliding contact between the cam surface 44 and the interface cap 48. The size, shape and materials of the interface cap 48 and the cam 40 are selected and constructed for a desired frictional coefficient at the interface therebetween. In one exemplary construction, the cam 40 and cam arm 42 are integrally formed having a consistent size and shape from one cam to the next using sintered powdered metal technology and the interface cap 48 is formed of an acetal resin, such as Delrin, a trademark of DuPont.

In an exemplary embodiment the cam lever 42 is moveable by a press operator with manually applied force. The cam lever 42 can be manually moved through the position range 58 for providing the thickness range 59 of metered ink thickness. The biased force and frictional coefficient act to retain the cam lever 42 and cam 40 in any desired metering position as may be manually selected by the press operator. External force applied to the cam lever 42 is required to change the metering position. Each of the cam levers 42A–O of each sub-assembly 11A–O may be separately positioned to meter the ink thickness at each of the separate metering blocks 14A–O.

Figure 4:
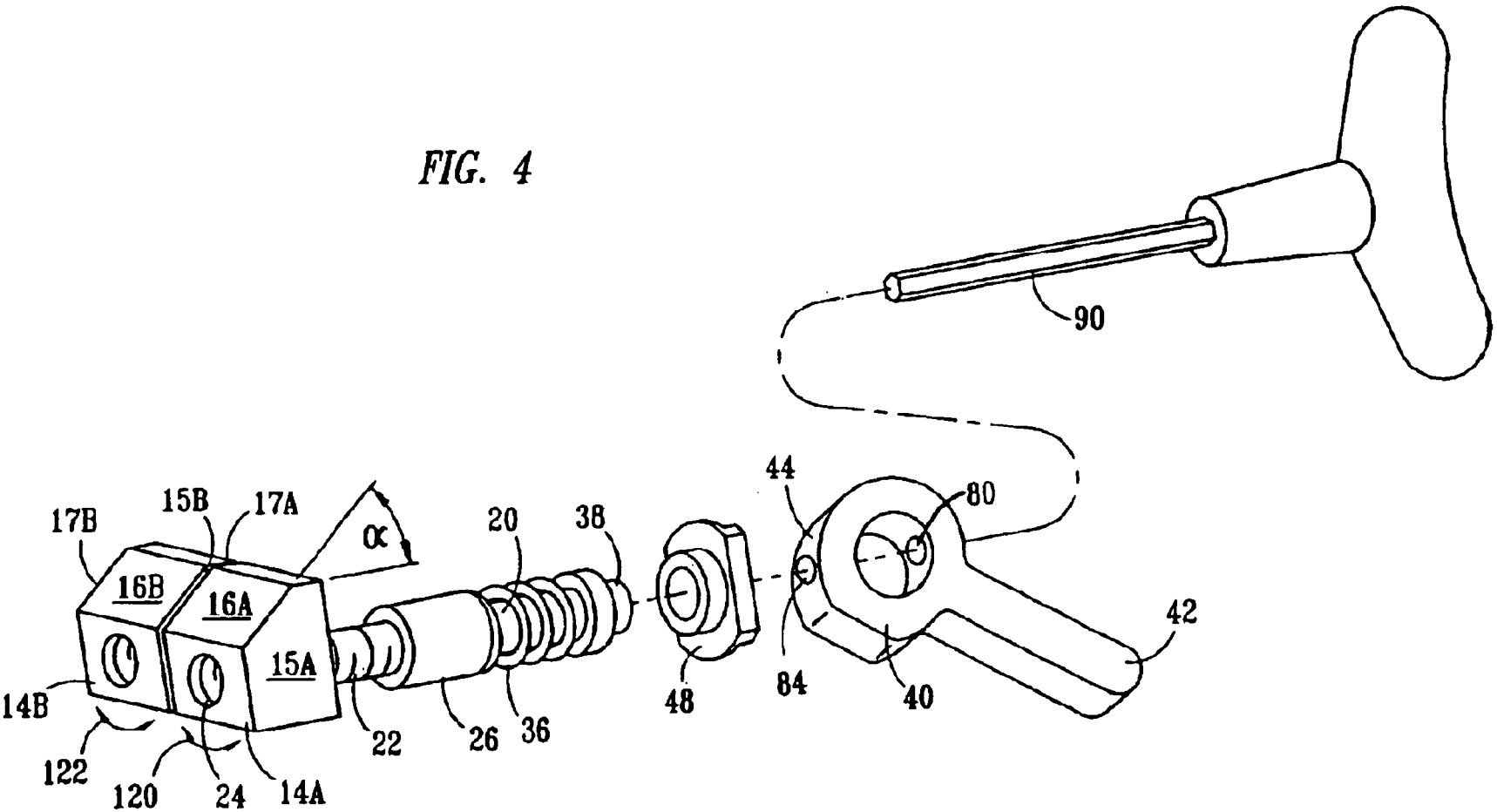
FIG. 4 is a perspective view of sub-assembly comprising a cam, interface cap and cam guide, adjustment bolt, and metering block illustrative of certain aspects of the invention

According to another aspect of the invention, each cam 40 is mounted on a mounting shaft 32 for rotation between the minimum and maximum metering positions, 50 and 54 respectively. Referring to FIGS. 1 and 4, a first adjustment orifice 80 is formed through each cam 40 extending diametrically through the cam 40. At each sub-assembly position along the mounting shaft, a second adjustment orifice 82 is formed diametrically through the mounting shaft 32. Each second adjustment orifice 82 is aligned with each bolt 20 and each siding hole 26. The interface cap 48 is also provided with a third orifice 84 centrally located for alignment with the head 38 of the bolt 20 and with the second orifice 82. Each first orifice 80 is formed in each cam 40 so that each first and second orifices, 80 and 82, are aligned when the cam 40 is in the minimum ink thickness position 50 of lever arm 42. In the embodiment depicted in FIG. 1, the minimum position 50 of lever arm 42 corresponds to the downward position. When aligned, the first second and third orifices, 80, 82 and 84 respectively, permit an adjustment tool 90 to be extended through the cam 40, through the mounting shaft 32, and through the cap 48 for engagement with the head 38 of adjustment bolt 20. The adjustment tool 90 (see FIG. 4) engages with the head of the bolt 20 and may be rotated in one direction to thread the adjustment bolt 20 into the metering block 14. The bolt 20 may be rotated the other direction to thread the adjustment bolt 20 out of the metering block 14. Preferably fine threads are used for precisely adjusting the position the metering block 14 relative to the main beam 30 and thus relative to the fountain roller 12 when the cam lever arm 42 of cam 40 is in the minimum position 50. The position of the metering block 14, relative to the fountain roller 12, determines the position of the ink liner relative to the surface 18, 50 that the minimum thickness 52 of the ink 68 in layer 70 is precisely adjustable at each metering block when each cam 40 is at its minimum position 50. The maximum thickness 56 of the ink 68 in layer 70 will also be adjusted upon adjusting the minimum thickness 52 because the eccentric lift of the cam 40 between the minimum position and the maximum position does not change. For example, if the eccentric lift of the cam is twenty thousandths of an inch (0.020 inch), from the minimum position 50 to the maximum position 54, and the minimum ink thickness 52 is adjusted, by turning the adjustment bolt 20, from one thousandth of an inch (0.001 inch) thick down to zero, the maximum thickness also will have been simultaneously adjusted from twenty-one thousandths of an inch (0.021 inch) thick down to twenty thousandths of an inch (0.020 inch) thick.

Referring now to FIG. 2, an ink fountain mechanism 10 according to an exemplary embodiment of the invention is depicted in a partial cutaway perspective view. A plurality of sub-assemblies 11A–O each constructed as described above with respect to FIG. 1 are provided adjacent to a plurality of zones, indicated generally with arrows A–O. The ink reservoir 64 is formed between the fountain roller 12, the ink liner 60 and two side plates 65L and 65R on opposite ends of the ink fountain mechanism 10. The ink liner 60 preferably comprises a thin sheet of resiliently flexible plastic material. A sheet of 7 mils thick polyester has been found to be useful for purposes of the present invention. The ink liner is supported at an oblique angle relative to horizontal so that ink 68 in the reservoir 64 will flow toward the fountain roller 12. A dispensing edge 66 is formed and positioned parallel and in close proximity to the cylindrical surface 18 of fountain roller 12. The ink liner 60 may extend along, and substantially aligned with, an imaginary line tangent to the cylindrical surface 18 of the fountain roller 12. The edge 66 of ink liner 60 may terminate at the roller surface 18. Alternatively, the edge 66 may extend slightly past the surface so that a flat portion 67 of the ink liner 60 is immediately adjacent to the surface 18 of fountain roller 12. The edge 66 is supported by the plurality of metering blocks 14A–O. Each metering block 14 is independently adjustable using a corresponding adjustable bolt 20 and then may be independently positioned for metering using cam lever arms 42, as described above with reference to FIG. 1. The metering blocks 14 support the edge 66 and flat portion 67 of ink liner 60 along the length of the fountain roller 12. Each metering block 14 has a flat upper surface 16 formed at about the same oblique angle relative to horizontal as the ink liner 60 is supported by the inclined base 62 of the fountain reservoir 64. The flat upper surface 16 of the metering block 14 extends across the width of each metering zone from one flat side 15 of the metering block to another flat side 17 of the metering block 14. Flat sides 15 and 17 are each formed at right angles to the upper flat surface 16 of the metering block 14. The metering blocks 14A–O are positioned side-by-side with only a very small clearance distance between adjacent sides. For example a right side 17A of one metering block 14A and a left side 15B of a next metering block 14B may be separated by less than a thousandths of an inch up to a few thousands of an inch clearance. Thus, while the blocks are independently adjustable they also remain vertically aligned side-by-side with adjacent metering blocks. The metering blocks 14 are each held at an adjustable horizontal position on the threads of one of the adjustment bolts 20, yet each metering block has a limited degree of free rotational floating about the axis of the adjustment bolt. It is through side-to-side contact between adjacent metering blocks and through contact of the upper flat surface 16 of the metering blocks 14 with the flat portion 67 at the edge 66 of ink liner 60 that the blocks 14 are able to "float" into substantially perfect alignment with surface 18 of the fountain roller 12. Thus, the partial rotational "floating" of the metering blocks 14 combined with the flexibility and resilient stiffness of the ink liner 60 has been found to be advantageous for permitting smooth yet independent adjustment of ink thickness in each zone. A smooth flat sheet of 7 mils thick polyester has been found to provide an advantageously useful combination of resilient stiffness and flexibility for this purpose. In one embodiment, to facilitate alignment of the plurality of metering blocks 14 and to further smooth the transition between one zone and the next, a strip of tape 110, such as durable, thin flourocarbon polymer tape, such as tape made of Teflon a DuPont trademark, having a thickness of a few thousandths of an inch thick. For example, a strip of Teflon tape 110 about 0.006" to about 0.007" thick ×0.5" to about 1.0" wide may be adhered along the flat surfaces 16A–O of the plurality of metering blocks 14A–O. The thin flexible tape 110 is thus positioned under the ink liner 60 and extends along the entire length of the roller 12. The tape 110 flexibly bridges across the gap between each block 14A and the next block 14B without restricting the independent adjustment of ink thickness at each zone.

A face plate 100 is provided to enclose the subassemblies 11. The face plate 100 has a plurality of substantially identical vertical slots 102 to permit access to the cam lever arms 42. In an exemplary embodiment the face plate 100 is also provided with graduated positioning marks 104 space along and adjacent to each vertical slot 102. The operator can thus adjust the ink thickness in any given zone by the position of the lever arm adjacent to that zone. The adjustment tool 90 is preferably only used for the initial set up to each minimum thickness to exactly zero. After the initial adjustment using adjustment tool 90, the thickness of ink can be adjustably metered using the position of the cam levers 42. When switching from one printing job to the next the lever arms 42, for the different zones A–O, are repositioned to provide the desired amount of ink in each of the plurality of zones. By making note of the lever arm positions, the same job could be set-up again later by repositioning the lever arms to the noted positions.

Reference to FIG. 3, which is an exploded assembly view of the ink fountain mechanism of FIGS. 1 and 2, provides additional understanding of the complete construction of the fountain mechanism 10. The pluralities of parts are indicated with numbered arrows and the individual parts are indicated with reference numbers corresponding to the same reference numbers as in FIGS. 1 and 2.

In FIG. 4 certain aspects of the invention are illustrated in a perspective view of a sub-assembly 11 comprising a cam 40 with attached lever arm 42, interface cap 48, adjustment bolt 20, bias spring 36, spacer 26 and metering block 14A. For illustration purposes only, an adjacent metering block 14B is also depicted (without the corresponding sub assembly 11B). The partial rotational "floating" of the metering blocks 14A and 14B is indicated by arrows 120 and 122 respectively. It will be noted that metering block 14A is depicted in a position adjusted back from metering block 14B, such that the ink thickness at metering block 14A will be thicker than the ink thickness at metering block 14B. The adjacent sides 17A and 15B, of metering blocks 14A and 14B, respectively, are in sliding contact with each other. The angle alpha ($\alpha$) of the upper flat support surfaces 16 is an oblique angle with respect to horizontal, and in the embodiment depicted is approximately 30 degrees relative to horizontal.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An ink fountain mechanism for adjustably metering the thickness of a layer of ink in a plurality of zones axially across an ink receiving fountain roller, comprising:

(a) a main beam that extends the length of the fountain roller;

(b) a plurality of metering blocks, horizontally aligned and axially adjacent to one another and each having an upper surface adjustably spaced from the ink receiving fountain roller;

(c) a plurality of adjustment bolts having heads, each separately and threadably engaged with each of the plurality of metering blocks, each metering block independently rotatable on the bolt threads such that the support surfaces independently align parallel to the fountain roller, the adjustment bolts slideably supported in the main beam that extends the length of the fountain roller;

(d) a plurality of cams pivotably attached to the main beam and positioned adjacent to the heads of each of the adjustment bolts, the cams engaged with the heads of the adjustment bolts and manually actuatable between a minimum position, providing a minimum ink metered thickness, and a maximum position, providing maximum metered ink thickness; and (e) a plurality of levers attached to the cams for manually actuating the cams, the levers progressively movable between the minimum and the maximum positions to provide substantially continuous metering of the thickness of ink in a range between the minimum and the maximum ink thickness.

2. The ink fountain mechanism of claim 1, wherein the metering blocks comprise vertical side surfaces and the upper support surface at an angle, wherein the metering blocks are positioned side-by-side with a small gap therebetween to permit independent alignment with the fountain roller by rotation on the threads of the bolts and so that the adjacent angled support surfaces of the metering blocks define a substantially continuous support surface with independently adjustable spacing from the fountain roller at each metering block along the length of the fountain roller.

3. The ink fountain mechanism of claim 2, further comprising an ink liner supported along the substantially continuous support surface formed by the angled top surfaces of the metering blocks, the ink liner comprising a continuous thin sheet of resilient and flexible material.

4. The ink fountain mechanism of claim 3, wherein the thin sheet of flexible resilient material of the ink liner comprises a thin sheet of plastic.

5. The ink fountain mechanism of claim 4, wherein the thin sheet of flexible resilient plastic material comprises a sheet of polyester about 7 mils thick.

6. The ink fountain mechanism of claim 1 further comprising a return spring held in the main beam so that it pushes against a bottom of the adjustment bolt head so that the top of the adjustment bolt head is biased to interface against the cam.

7. The ink fountain mechanism of claim 6 further comprising a interface cap constructed of a material selected to provide non-binding frictional sliding contact between the cam and the interface cap and wherein the bolt head interfaces against the cam through the interface cap.

8. The ink fountain mechanism of claim 7 wherein the interface cap comprises a material selected to provide non-binding frictional sliding contact between the cam and the cap and the size, shape and materials of the cap at the interface between the cap and the cam are selected and constructed so that the cam lever can be manually moved through the range of ink thickness metering positions, yet will remain in any desired metering position by the frictional contact between the cam and the cap.

9. The ink fountain mechanism of claim 6 further comprising a interface cap constructed of a plastic material to provide non-binding frictional sliding contact between the cam and the interface cap and wherein the bolt head interfaces against the cam through the interface cap.

10. The ink fountain mechanism of claim 9, wherein the plastic interface cap further comprises an acetal resin material.

11. The ink fountain mechanism of claim 1 further comprising an ink liner supported along an edge by the plurality of metering blocks, the metering blocks having angled planar upper support surfaces and a strip of durable tape adhered across the top surfaces of the plurality of metering blocks and interposed between the metering blocks and the ink liner.

12. The ink fountain mechanism of claim 11, wherein strip of durable tape adhered across the top surfaces of the plurality of metering blocks and interposed between the metering blocks and the ink liner comprises a fluorocarbon polymer material adhered to the metering blocks and providing friction reduced relative movement against the liner.

13. An ink fountain mechanism for adjustably metering the thickness of a layer of ink in a plurality of zones axially across an ink receiving fountain roller, comprising:

(a) a main beam that extends the length of the fountain roller;

(b) a plurality of metering blocks, horizontally aligned and axially adjacent to one another and each having an upper surface adjustably spaced from the ink receiving fountain roller;

(c) a plurality of adjustment bolts having heads, each separately and threadably engaged with each of the plurality of metering blocks, the adjustment bolts slideably supported in the main beam that extends the length of the fountain roller;

(d) a plurality of cams pivotably attached to the main beam and positioned adjacent to the heads of each of the adjustment bolts, the cams engaged with the heads of the adjustment bolts and manually actuatable between a minimum position, providing a minimum ink metered thickness, and a maximum position, providing maximum metered ink thickness, wherein each cam is mounted on a mounting shaft held by the main beam for rotation between the minimum and maximum metering positions and wherein orifices are formed through the cam and the mounting shaft, such that in one metering position the orifices are aligned to permit access through the orifices to the adjustment bolt, for an adjustment tool to be extended through the cam and the mounting and (e) a plurality of levers attached to the cams for manually actuating the cams, the levers continuously movable between the minimum and maximum positions to provide substantially continuous metering of the thickness of ink in a range between the minimum and the maximum ink thickness.

14. The ink fountain mechanism of claim 13, further comprising a interface cap constructed of a material selected to provide non-binding frictional sliding contact between the cam and the interface cap, the interface cap having an orifice through it, and wherein the bolt head comprises a cap screw head such as an Allen bolt head that interfaces with the cam through the interface cap and an adjustment tool comprising an elongate wrench sized for accessing the cap head of the bolt through the cam, the mounting shaft and the interface cap.

15. An ink fountain mechanism for adjustably metering the thickness of a layer of ink in a plurality of zones axially across an ink receiving fountain roller, comprising:

(a) a main beam that extends the length of the fountain roller;

(b) a plurality of metering blocks, horizontally aligned and axially adjacent to one another and each having vertical side surfaces, an upper surface at and angle adjustably spaced from the ink receiving fountain roller, wherein the metering blocks are positioned side-by-side and so that the adjacent angled support surfaces of the metering blocks define a substantially continuous support surface with independently adjustable spacing from the fountain roller at each metering block along the length of the fountain roller;

(c) a plurality of adjustment bolts having heads, each separately and threadably engaged with each of the plurality of metering blocks, the adjustment bolts slideably supported in the main beam that extends the length of the fountain roller, (d) a plurality of cams pivotably attached to the main beam and positioned adjacent to the heads of each of the adjustment bolts, the cams engaged with the heads of the adjustment bolts and manually actuatable between a minimum position, providing a minimum ink metered thickness, and a maximum position, providing maximum metered ink thickness; and (e) a plurality of levers attached to the cams for manually actuating the cams, the levers progressively movable between the minimum and the maximum positions to provide substantially continuous metering of the thickness of ink in a range between the minimum and the maximum ink thickness.

* * * * *

UNITED STATES PATENT AND TRADEMARK OFFICE

CERTIFICATE OF CORRECTION

PATENT NO. : 6,802,255 B2
DATED : October 12, 2004
INVENTOR(S) : James J. Keller It is certified that error appears in the above-identified patent and that said Letters Patent is hereby corrected as shown below:

Title page,
Item [57], ABSTRACT,
Line 2, please remove the second occurrence of "of".

Column 8,
Line 62, please insert -- shaft; -- after the word "mounting".

Signed and Sealed this

First Day of March, 2005

JON W. DUDAS
*Director of the United States Patent and Trademark Office*